United States Patent [19]

Irvine et al.

[11] 4,030,722

[45] June 21, 1977

[54] SHEET-MATERIAL SEPARATOR AND FEEDER SYSTEM

[75] Inventors: Robert Irvine, Riverside; Harry E. Luperti, Wilton, both of Conn.

[73] Assignee: Pitney-Bowes, Inc., Stamford, Conn.

[22] Filed: May 13, 1975

[21] Appl. No.: 577,002

[52] U.S. Cl. ..... 271/10; 271/111; 271/116; 271/125; 271/259

[51] Int. Cl.[2] ..... B65H 3/46; B65H 7/18

[58] Field of Search ..... 271/8 A, 10, 34, 35, 271/110, 111, 114, 116, 122, 125, 258, 259, 265, 273, 274, 121, 124

[56] References Cited

UNITED STATES PATENTS

| | | | |
|---|---|---|---|
| 650,410 | 5/1900 | Morin | 271/121 |
| 3,108,801 | 10/1963 | van Dalen | 271/34 |
| 3,575,410 | 4/1971 | Suzuki | 271/111 |
| 3,825,248 | 7/1974 | Friend | 271/10 |
| 3,927,876 | 12/1975 | Wojtowicz | 271/111 |
| 3,981,493 | 9/1976 | Klappenecker et al. | 271/10 |
| 3,988,017 | 10/1976 | Kuhl | 271/10 X |

FOREIGN PATENTS OR APPLICATIONS

| | | | |
|---|---|---|---|
| 2,309,756 | 9/1974 | Germany | 271/265 |

*Primary Examiner*—Robert W. Saifer

*Attorney, Agent, or Firm*—Robert S. Salzman; William D. Soltow, Jr.; Albert W. Scribner

[57] ABSTRACT

A high speed sheet-material separating and feeder system is disclosed which handles a wide range of mixed thicknesses and sizes of envelopes and sheets. In a free running mode, the system can conservatively handle 30,000 pieces of mail per hour. The sheets are stacked at one end of the system, and are fed to a first of two separator mechanisms. The first separator mechanism is adjusted for thicker sheets of the range. Sheets leaving the first separator are then fed to the second of the two separator mechanisms. The second separator is adjusted for thinner sheets of the range. Sheets leaving the second separator are ejected one at a time, in seriatim, where they then can be fed to other sheet handling equipment for processing.

20 Claims, 3 Drawing Figures

SHEET-MATERIAL SEPARATOR AND FEEDER SYSTEM

The invention pertains to sheet-handling equipment, and more particularly to a sheet-material separator and feeder system.

BACKGROUND OF THE INVENTION

At present, there is an ever increasing need for machinery that can handle mixed mail, envelopes, and other varying sheet-like material at high speed. Heretofore, machinery designed to process large amounts of mixed mail at high speed has been always limited to a narrow range of envelope thicknesses and sizes. This was due to the fact that there is no known separators and feeders that can automatically deliver separated mixed sheet outside of a very limited range. Separators that are adjustable for thicker sheet will not function properly for thinner materials and vice versa. Therefore, if a wide range of material is fed into these devices, double feeds, jams, and other unacceptable conditions, will result. Clearly, there exists a need for an automatic (no adjustment) separating and feeding system that will provide a high speed steady stream of mixed material. The present invention addresses itself to this requirement.

SUMMARY OF THE INVENTION

The invention is for a sheet-material separating and feeding system for handling a wide range of sheet thicknesses and sizes at high speed. The system does not require on-going adjustments or a pre-sorting of materials.

The inventive separator and feeder system comprises a novel pair of separators acting in a cooperating, synergistic manner to automatically separate and feed letter sizes in a range between 3½× 6 inches, and 10 × 13 inches. The system can handle all thickness of mail from postcard or airmail up to ½inch thick letters.

At the beginning of the system is a stacker where the mixed mail or sheet-material is supported. A feed hang-up picks off one or more letters from the stack of mail and feeds them to a pair of spaced apart separators. The first separator of the pair is set to handle the thicker envelopes at the ½inch end of the thickness range. The second separator, located downstream of the first separator, is adjusted to process the thinner envelopes of the range such as airmail letters and postcards. The separators are spaced apart a distance approximately equal to or less than the length of a minimum envelope (approximately 5¼ inches). This specific distance is important, because the first separator adds its force to the second separator, when a letter is spaced between them. If this distance were greater, then small envelopes would tend to hang-up or "float" between the second and first separators.

A synergistic effect is obtained from the separators by means of clutching. The feed roller and the first separator are clutch controlled. Photosensors are located slightly downstream of each separator and control the clutch mechanisms. The photosensor associated with the first separator controls the feed roller clutch. When a piece of mail exits the first separator, the leading edge of the mail blocks the photosensor. A signal is sent to the feed roller clutch to disengage, so that additional pieces of mail will not be sent to the first separator. When the trailing edge of the letter is sensed, the feed roller is once again engaged. The engaging and disengaging of the feed roller is responsive to the discharge of the first separator, and allows for a more effective separation and feeding of the mail.

Similarly the photosensor associated with the second separator controls the first separator clutch and the feed roller clutch in a like manner. The feed roller and first separator will not feed until a piece of mail occupying the second separator is completely discharged (the trailing edge is sensed).

The sensing and clutching of the first separator and feed roller provides a "traffic or flow control" to both of the separator units. The cooperation between separators is enhanced beyond the mere combining of the two separating units. Thus, a synergistic effect is provided by the two separators due to the flow control interrelationships between them.

The separator and feeder system of this invention can be run in two different modes:

a. free running; or b. demand feed.

In the free running mode, the second separator unit is not controlled by any downstream mail-handling machinery. Mail is discharged one unit at a time, in seriatim, as fast as the separator and feeder system is allowed to run. Consequently, the system will deliver 30,000 pieces per hour.

In the demand feed mode, the second separator is clutch controlled, and receives a feed signal from mail-handling machinery located downstream.

In either mode, the separator and feeder system of this invention will deliver mixed sheet-material, envelopes, letters or mail, in a one-at-a-time, seriatim fashion. There should never be any doubles or multiple feeds when the inventive separator and feeder system is working properly.

It is an object of the present invention to provide an improved separating and feeding system;

It is another object of this invention to provide a separating and feeder system that will handle a wide range of sheet thicknesses and sizes; and It is still another object of the inventive separating and feeding system to deliver inter-mixed sheet-material at high speed, one at a time, in seriatim. These and other objects of this invention will be better understood and will become more apparent with reference to the following detailed description taken in conjunction with the attached drawings, in which.

Figure 2:
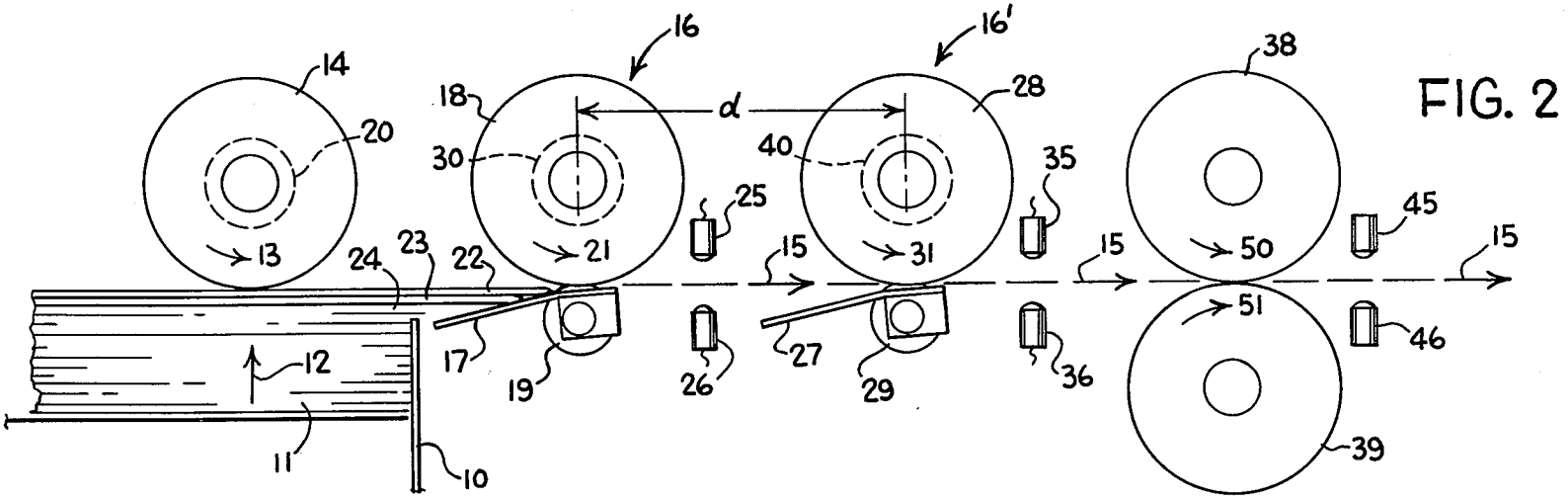
FIG. 2 is a plan view of the invention of FIG. 1.
Figure 3:
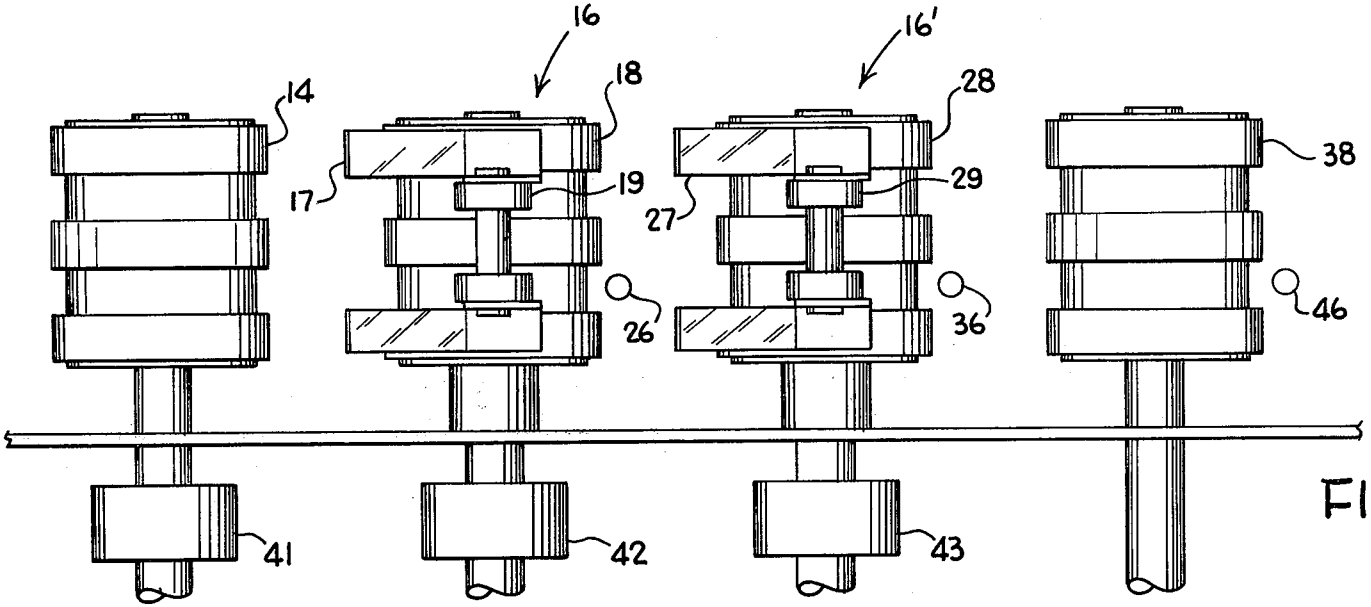

FIG. 3 is a frontal view of the inventive system shown in FIG. 2. Generally speaking, the invention is for a separating and feeding system for sheet-like materials, envelopes, letters and pieces of mail. The system is designed to handle a wide range of thicknesses of sheet, and deliver the sheet in seriatim to a sheet-handling device. The system comprises a stacking means, which is located at the beginning of a feed path for the sheet. A feeding means is disposed adjacent and stacking means and feeds one or several pieces of sheet from the stacking means. These sheets are fed to a first separating means disposed along the feed path downstream from the stacking means. This separating means is adjusted to separate thicker sheets of the range of thicknesses of the sheets. Thinner sheets will naturally be allowed to pass through. This first separator will separate a majority of the sheets presented to it. The separated material is then fed to a second separating means, which is located downstream of the first separating means. The second separating means is adjusted to separate the thinner sheets of the range of sheet thicknesses, but thicker sheets will be forced through, so that the full range of thicknesses will be separated. The first and second separating means act cooperatively to provide a material handling device with one sheet at a time in seriatim. Each separating means comprise a forward thrusting element and an adjacent retarding element for separating multiple sheets disposed therebetween. The cooperation between the separating means is provided by a traffic control means, which monitors and controls the flow of sheet through the system.

Figure 1:
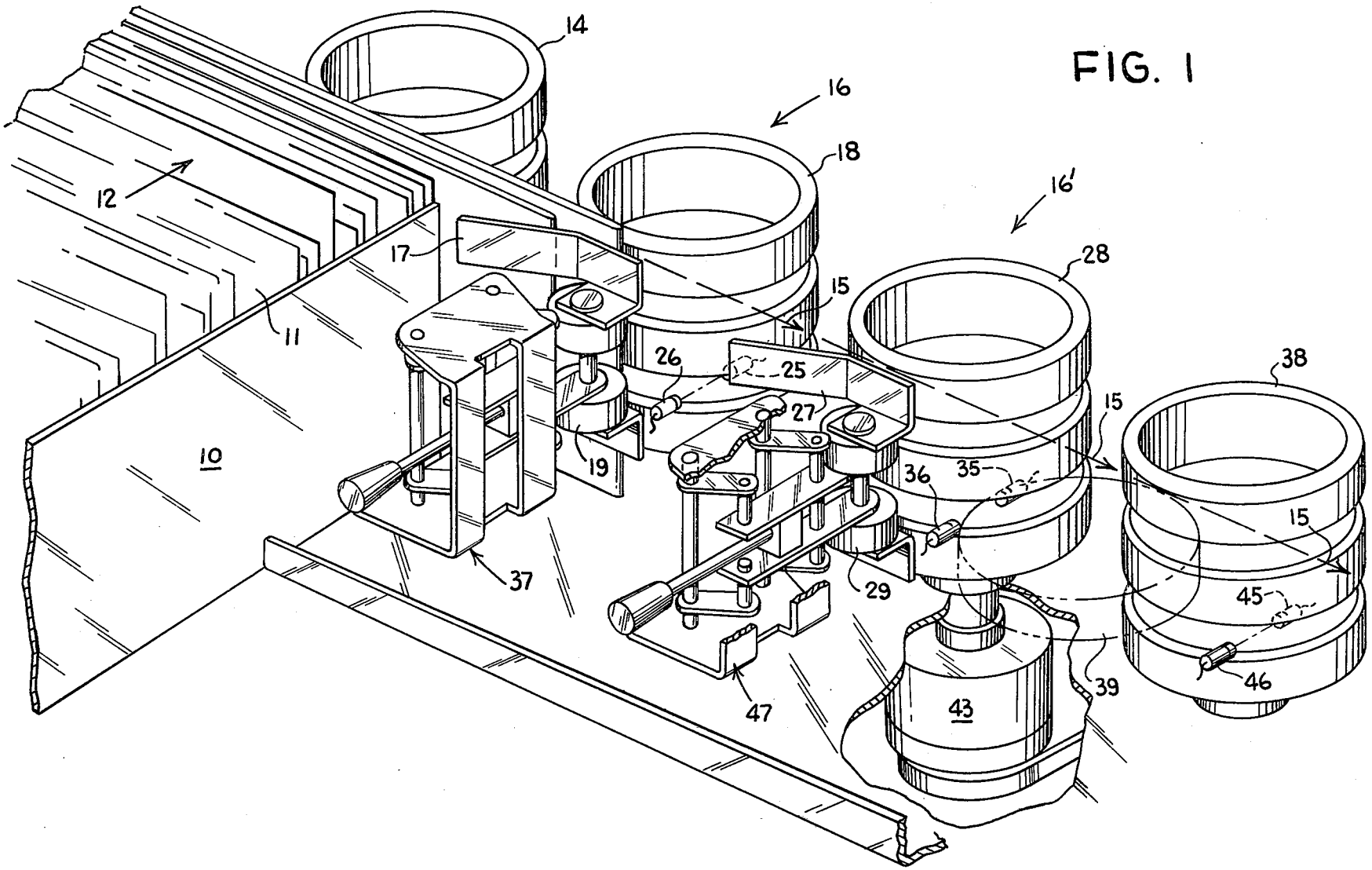
FIG. 1 is a perspective view of the separating and feeding system of this invention.

Now referring to FIGS. 1 and 2, a stacker 10 is shown for supporting and guiding a quantity of mixed mail 11. The mail 11 varies in thickness from postcard or airmail thicknesses up to ½ inch. The size of the envelopes vary from 3½inches × 6 inches up to 10 inches × 13 inches. The letters are fed (arrow 12) towards a forward rotating (arrow 13) feed roller 14, where they are frictionally "picked-off".

The feed roller 14 starts the mail along a feed path generally shown by arrows 15. The feed roller may shingle one or more letters from the pack 11. These letters are urged towards a first separating station shown generally by arrow 16. The separator station comprises a fence 17, which is angled in such a way so as to direct pieces of mail towards a pair of rollers, 18 and 19. Roller 18 is a forward rotating roller (arrow 21, FIG. 2) that frictionally engages with envelopes caught in the bite of the rollers 18 and 19, and directs the letters forward. Roller 19 is a retarding roller that frictionally engages with envelopes caught in the bite of the rollers 18 and 19. This roller tends to separate and retard multiple letters from going through the roller pair. Roller 18 has a high coefficient of friction with respect to paper of 1.3 or greater, which will positively drive pieces of mail forward. Roller 19, on the other hand, has a coefficient of friction approximately between 0.5 to 0.8, which is greater than that of paper to paper, but less than the feed roller to paper. Thus, if multiple pieces of mail enter the bite of the roller pair, the envelope 22 nearest drive roller 18 will be forced forward, and letters 23, 24, etc. will be retarded from forward movement. Roller 19 is stationary, but can be given a reverse rotation in certain applications.

Letters 22, 23 and 24 will normally tend to move together as a unit mass. This is due to the pack pressure of the stack, which creates a frictional drag on each contiguous piece of mail. The reverse roller 19, however, has a greater frictional engagement with these letters, and will retard the multiple pieces of mail from moving forwards. Only letter 22 (letter nearest roller 18) will tend to move forward, because of the higher engaging friction of roller 18.

The separator roller pair 18 and 19 are interdigitated as shown in FIGS. 2 and 3, so as to provide a positive intermeshing bite. This positive bite is further enhanced by spring loading (not shown) the rollers toward each other. This biasing also achieves the normal force which causes the drive.

The separator rollers 18 and 19 of station 16 have a small, adjustable overlap therebetween. This small overlap is adjusted for letters in the upper end of the thickness range (½inches end). A lesser engaging bite is useful, since the cooperating driving force of feed roller 14 is diminished due to the drag created by the stack pressure. The small overlap aids in the entry of thicker pieces of mail to the separator.

The envelopes leaving the first pair of separating rollers are discharged to a second separator station 16'. This station has a similar pair of interdigitated separating rollers 28 and 29, and a fence 27. Roller 28 rotates in a forward direction (arrow 31) the same as roller 18, while roller 29 is stationary as is roller 19. These rollers have the same coefficients of friction as their earlier counterparts.

Separating rollers 28 and 29 have an adjustable overlap therebetween, that is set for thinner letters of the thickness range such as airmail letters or postcards. Rollers 28 and 29 are also spring biased toward each other (not shown).

Adjustment linkages 37 and 47 are schematically shown in FIG. 1. Linkage 37 is used to adjust the overlap of separator rollers 18 and 19, and linkage 47 sets the overlap for separator rollers 28 and 29.

While the second separator station 16' has rollers which are adjusted for thin pieces of mail, thicker envelopes are able to get through. This is so, because the first pair of separator rollers 18 and 19 add a forward force to the second separating station.

Stations 16 and 16' are separated by a distance *d* (FIG. 2) approximately equal to or less than a minimum envelope length (approximately 5¼inches). This insures that even the smallest letters will not get "hung-up" (float) between the stations (will be in the bite of both separators).

Pieces of mail leaving the second separator station 16' will be discharged one at a time in seriatim to another mail-handling machine such as a facer-canceller. Rollers 38 and 39 represent the intake of this machine. Both rollers are shown rotating in a forward direction (arrows 50 and 51; FIG. 2).

The feed roller 14 and separator rollers 18 and 28, are controlled by clutches 41, 42, 43, respectively, as shown in FIG. 3. These clutches rotatively engage and disengage these rollers from driving the pieces of mail along feed path 15. Each clutch is activated and deactivated by a photosensor device, whose light path intersects the feed path 15. Each photosensor unit comprises a light emitting diode (LED), and a phototransistor.

Photosensor elements 25, 26 are shown immediately downstream of the first separator rollers (FIGS. 1 and 2), and are used to control the feeder clutch 41 (FIG. 3).

A second photosensor element pair 35, 36 (FIGS. 1 and 2) is shown immediately downstream of the second separator rollers, and is used to actuate clutches 41 and 42 (FIG. 3) controlling the feed roller 14 and the first separator roller 18, respectively.

In the "demand feed" mode, clutches 41, 42 and 43 (FIGS. 1 and 3) controlling the feed roller 14, and the first and second separator rollers 18 and 28, respectively, can be actuated by photosensor elements 45, 46. Each of the drive rollers 14, 18 and 28 are mounted to their respective shafts by over-running clutches 20, 30 and 40 (FIG. 2), respectively. These over-running clutches allow the mail to be pulled forward by subsequent drive rollers, when any of these rollers are disengaged by their respective driving clutches 41, 42 and 43. If this were not so, when any of the drive rollers 14, 18 and 28 were stopped from rotating, they would retard the forward progress of the letters in their bite.

OPERATION OF THE INVENTION

As aforementioned, a stack of inter-mixed mail or sheet material is introduced to feed roller 14 from the stacker 10. The feed roller 14 shingles the envelopes in feeding them to a first separator station 16. When an envelope is discharged from the separator rollers 18 and 19, the leading edge of the letter will break the light path between the photosensor elements 25 and 26. When this occurs, clutch 41 (FIG. 3) controlling feed roller 14 is deactivated by a signal from the photosensor. The feed roller 14 will now cease to feed any more pieces of mail to the first separator until the trailing edge of the discharged letter passes the last pair of photosensor elements.

As a letter is discharged from separator station 16, it enters a second pair of separator rollers 28 and 29 of separator station 16'. As previously mentioned, this separator is adjusted for thinner pieces of mail, but is able to pass thicker envelopes due to the additional drive force provided by the first separator rollers. When a piece of mail is discharged from rollers 28 and 29, the leading edge of the envelope will break the light path between photosensor elements 35 and 36. A signal is now sent to deactuate clutches 41 and 42 (FIG. 3). Feed roller 14 and separator roller 18 will then cease to drive any mail until the trailing edge of the discharged envelope passes photosensor elements 35 and 36.

In the "free running" mode, pieces of mail will be discharged one at a time in seriatim from the second separator station 16'. The speed by which the letters are expelled will depend upon the speed of driving rollers 14, 18 and 28.

In the demand feed mode of operation, all the drive rollers including the second separator roller 28 are clutch controlled. The clutches 41, 42 and 43 will rotatively engage and disengage their respective drive rollers depending upon an extraneous signal (or lack of signal) frm a contiguous mail-handling device. One way of providing such a signal is shown in FIGS. 1 and 2 by photosensor elements 45 and 46.

When an envelope enters the mail-handling device feed-in rollers 38 and 39, it is discharged past photosensor elements 45 and 46. The leading edge of the letter will provide a signal to clutches 41, 42 and 43 (FIG. 3) to deactuate these clutches, and rotatively disengage rollers 14, 18 and 28. Rollers 14, 18 and 28 will not feed another envelope until the trailing edge of the letter positioned in front of photosensor elements 45 and 46 moves past.

Thus, only one letter at a time will be fed to the mail handling device. The speed at which letters will be discharged can be regulated by the speed of rollers 38 and 39, or other extraneous conditions of the mail-handling device.

Of course, many obvious changes in the invention can be made. For example, the photosensors can be replaced by other types of proximity or limit-type switches. Driving speeds, and distances between various elements such as drive elements, photosensors, and between photosensors and drive elements may vary depending upon the mode of operation of the invention or the overall purpose of the system.

All such changes that will occur to the skilled practitioner in this art, are deemed to lie within those limits encompassed by the invention.

The spirit and scope of the invention is represented by the appended claims.

What is claimed is:

1. An automatic material separating and feeding system separating a range of inter-mixed thicknesses of sheet-like material and feeding the separated sheet-like material in seriatim to a material-handling device, said material separating feeder system comprising:

means defining a material handling feed path;

stacking means disposed at the beginning of said feed path for stacking a quantity of inter-mixed thicknesses of sheet-like material;

a feeding means disposed adjacent said stacking means for feeding a portion of said quantity of material towards a first separating means;

a first separating means disposed along said feed path downstream from said stacking means for separating and feeding the material towards a second separating means, said first separating means comprising a first forward material thrusting element and a first adjacent material retarding element for separating multiple sheet-like materials disposed therebetween, a first independent clutching means for engaging and disengaging said first forward material thrusting element, said first forward material thrusting element including an overrunning clutch for allowing sheet-like material to be pulled forward by a subsequent forward material thrusting element when said first forward material thrusting element is disengaged; and a second separating means disposed along said path downstream from said first means a distance less than a minimum length for said sheet-like material in said range of sheet-like materials, so that at one time during the separation of said sheet-like material, said sheet-like material will be in a bite of both separating means, said second separating means for separating and feeding the material towards a material-handling device, said second separating means comprising a second forward material thrusting element and a second adjacent material retarding element for separating multiple sheet-like materials disposed therebetween, a second clutching means for engaging and disengaging said second forward material thrusting element, said second forward material thrusting element including an over-running clutch for allowing sheet-like material to be pulled forward by a subsequent forward material thrusting element when said second forward material thrusting element is disengaged, said second separating means working cooperatively with said first separating means, such that said sheet-like material is fed to said material-handling device one sheet at a time in seriatim.

2. The automatic material separating and feeding system of claim 1, wherein each of said first and said second means comprise a forward rotating feed roller, and, a complementary retarding roller.

3. The automatic material separating and feeding system of claim 1, wherein said feeding means comprises a feed roller that frictionally engages with sheet-like material of the stacking means, and feeds said material towards the first separating means, and a feed clutch operatively connected to said feed roller for causing said feed roller to rotatively engage with, and disengage from, said sheet-like material of said stacking means.

4. The automatic material separating and feeding system of claim 3, further comprising a first sensing means disposed along said feed path adjacent said first separating means on a downstream side thereof, said first sensing means for sensing a leading and trailing edge of sheet-like material leaving said first separating means and providing first electrical signals in response to the sensing of the leading and trailing edge, and means for coupling these first signals to said feed clutch, whereby the feed roller of said feeding means is rotatively disengaged from, and rotatively engaged into, feeding said sheet-like material of said stacking means.

5. The automatic material separating and feeding system of claim 4, further comprising a second sensing means disposed along said feed path adjacent said second separating means on a downstream side thereof, said second sensing means for sensing a leading and trailing edge of sheet-like material leaving said second separating means and providing second electrical signals in response to the sensing of the leading and trailing edge, said first independent clutching means for engaging and disengaging said first forward material thrusting element including a first clutch operatively connected to said first forward material thrusting element for causing said first forward material thrusting element to disengage from, and engage with, said sheet-like material, and means for coupling said second electrical signals to said feed and said first clutches.

6. The automatic material separating and feeding system of claim 5, wherein said second independent clutching means comprises a second clutch operatively connected to said second forward material thrusting element, means for providing demand feed signals from said material-handling device, and means for coupling the demand feed signals to said feed, first, and second clutches for causing said feeding means, and said first and second forward material thrusting elements to disengage from, and engage with, said sheet-like material.

7. An automatic envelope separating and feeding system for separating a range of inter-mixed thicknesses and sizes of envelopes, and feeding the separated envelopes in seriatim to an envelope-handling device, said envelope separating and feeding system comprising:

means defining an envelope feed path;

stacking means disposed at the beginning of said feed path for stacking a quantity of inter-mixed thicknesses and sizes of envelopes;

a feeding means disposed adjacent said stacking means for feeding a portion of said quantity of envelopes towards a separating means;

a first and second separating means disposed along said feed path downstream of said stacking means, the second separating means being disposed downstream from said first separating means by a length less than that of a minimum size envelope length, said first and second separating means each comprising a forward envelope thrusting element and an adjacent envelope retarding element for separating multiple envelopes disposed therebetween, said first and second separating means further comprising independent clutching means for engaging and disengaging each of said forward envelope thrusting elements, respectively, and an overrunning clutch for each of said forward envelope thrusting elements for allowing an envelope to be pulled forward when its respective forward envelope thrusting element is disengaged.

8. The automatic envelope separating and feeding system of claim 7, wherein said first separating means generally separtes thicker envelopes in a range of inter-mixed envelope thicknesses.

9. The automatic envelope separating and feeding system of claim 7, wherein said second separating means generally separates thinner envelopes in a range of inter-mixed envelope thicknesses.

10. The automatic envelope separating and feeding system of claim 7, wherein each of said first and second forward envelope thrusting elements comprise a forward rotating feed roller, and each of said retarding elements comprise a retarding roller.

11. The automatic envelope separating and feeding system of claim 7, wherein said feeding means comprises a feed roller that frictionally engages with envelopes of the stacking means, and feeds said envelopes towards the first separating means, and a feed clutch operatively connected to said feed roller for causing said feed roller to rotatively engage with, and disengage from, the envelopes of said stacking means.

12. The automatic envelope separating and feeding system of claim 11, further comprising a first sensing means disposed along said feed path adjacent said first separating means on a downstream side thereof, said first sensing means for sensing a leading and trailing edge of an envelope leaving said first separating means and providing first electrical signals in response to the sensing of the leading and trailing edge, and means for coupling these first electrical signals to said feed clutch, whereby the feed roller of said feeding means is rotatively disengaged from, and rotatively engaged into, feeding the envelopes of said stacking means.

13. The automatic envelope separating and feeding system of claim 12, further comprising a second sensing means disposed along said feed path adjacent said second separating means on a downstream side thereof, said second sensing means for sensing a leading and trailing edge of an envelope leaving said second separating means and providing second electrical signals in response to the sensing of the leading and trailing edge, said independent clutching means comprising a first clutch operatively connected to said first separating means for causing said first separating means to disengage from, and engage with, any envelopes disposed therein, and means for coupling said second electrical signals to said feed and first clutches.

14. The automatic envelope separating and feeding system of claim 13, wherein said independent clutching means comprises a second clutch operatively connected to said second separating means, means for providing demand feed signals from said material-handling device, and means for coupling the demand feed signals to said feed, first, and second clutches for causing said feeding means, and said first and second separating means to rotatively disengage frm, and rotatively engage with, said sheetlike material.

15. An automatic envelope separating and feeding system separating a range of inter-mixed thicknesses of envelopes, and feeding the separated envelopes in seriatim to an envelope-handling device, said envelope separating and feeding system comprising:

means defining an envelope feed path;

stacking means disposed at the beginning of said feed path for stacking a quantity of inter-mixed thicknesses of envelopes;

a feeding means disposed adjacent said stacking means for feeding a portion of said quantity of envelopes towards a separating means;

a first separating means disposed along said feed path downstream from said stacking means for generally separating thicker envelopes in said range of inter-mixed thicknesses, and feeding the separated envelopes towards a second separating means, said first separating means comprising a first forward envelope thrusting element and a first adjacent envelope retarding element for spearating multiple envelopes disposed therebetween, a first independent clutching means for engaging and disengaging said first forward envelope thrusting element, said first forward envelope thrusting element including an over-running clutch for allowing sheet-like material to be pulled forward by a subsequent forward envelope thrusting element when said first forward envelope thrusting element is disengaged; and a second separating means disposed along said feed path downstream from said first separating means by a distance less than a minimum length of an envelope in said range of envelopes, so that at one time in the separation of said envelopes, an envelope will be in a bite of both separating means, said second separating means for generally separating thinner envelopes in said range of inter-mixed thicknesses, and feeding the separated envelopes towards an envelope-handling device, said second separating means comprising a second forward envelope thrusting element and a second adjacent envelope retarding element for separating multiple envelopes disposed therebetween, a second independent clutching means for engaging and disengaging said second forward envelope thrusting element, said seond forward envelope thrusting element, said second forward envelope thrusting element including an oven-running clutch for allowing sheet-like material to be pulled forward by a subsequent forward envelope thrusting element when said second forward envelope thrusting element is disengaged, said second separating means such that said envelopes are fed to said envelope-handling device one envelope at a time in seriatim.

16. The automatic envelope separating and feeding system of claim 15, wherein each of said first and second forward envelope thrusting elements comprise a forward rotating feed roller, and each of said first and second retarding elements comprise a retarding roller.

17. The automatic envelope separating and feeding system of claim 15, wherein said feeding means comprises a feed roller that frictionally engages with envelopes of the stacking means, and feeds said envelopes towards the first separating means, and a feed clutch operatively connected to said feed roller for causing said feed roller to rotatively engage with, and disengage from, the envelopes of said stacking means.

18. The automatic envelope separating and feeding system of claim 17, further comprising a first sensing means disposed along said feed path adjacent said first separating means on a downstream side thereof, said first sensing means for sensing a leading and trailing edge of an envelope leaving said first separating means and providing first electrical signals in response to the sensing of the leading and trailing edge, and means for coupling these first electrical signals to said feed clutch, whereby the feed roller of said feeding means is rotatively disengaged from, and rotatively engaged into, feeding the envelopes of said stacking means.

19. The automatic envelope separating and feeding system of claim 18, further comprising a second sensing means disposed along said feed path adjacent said second separating means on a downstream side thereof, said second sensing means for sensing a leading and trailing edge of an envelope leaving said second separating means and providing second electrical signals in response to the sensing of the leading and trailing edge, said first independent clutching means comprising a first clutch operatively connected to said first forward envelope thrusting element for causing said first forward envelope thrusting element to disengage from, and engage with, any envelopes disposed in said first separating means, and means for coupling said second electrical signal to said feed and first clutches.

20. The automatic envelope separating and feeding system of claim 19, wherein said second independent clutching means comprises a second clutch operatively connected to said second forward envelope thrusting element, means for providing demand feed signals from said material-handling device, and means for coupling the demand feed signals to said feed, first, and second clutches for causing said feeding means, and said first and second forward envelope thrusting elements to disengage from, and engage with, said sheet-like material.

* * * * *

UNITED STATES PATENT AND TRADEMARK OFFICE

CERTIFICATE OF CORRECTION

PATENT NO. : 4030722

DATED : June 21, 1977

INVENTOR(S) : R. Irvine et al.

It is certified that error appears in the above-identified patent and that said Letters Patent are hereby corrected as shown below:

Column 1, line 41 change "hang-up" to --roller--.

Column 3, line 54 change "forwards" to --forward--.

Column 4, line 25 enter quotation marks around the letter d.

Column 5, line 39 change "frm" to --from--.

IN THE CLAIMS:

Claim 14, Column 8, line 9 change "frm" to --from--.

Claim 15, Col 9, line 11 change "spearating' to --separating--.

Claim 15, Column 9, line 40 change "oven-running' to --over-running--.

Signed and Sealed this

*Fourth* Day of *October 1977*

[SEAL]

*Attest:*

RUTH C. MASON
*Attesting Officer*

LUTRELLE F. PARKER
*Acting Commissioner of Patents and Trademarks*